US005130693A

United States Patent [19]

Gigandet

[11] Patent Number: 5,130,693

[45] Date of Patent: Jul. 14, 1992

[54] SOUND-EFFECTS GENERATING DEVICE FOR ACTIVITY TOYS OR VEHICLES

[76] Inventor: Henri J. Gigandet, 2390 Frenette Street, Ville St-Laurent, Quebec, Canada, H4R 1M4

[21] Appl. No.: 473,063

[22] Filed: Jan. 31, 1990

[51] Int. Cl.[5] ..... G08B 3/00

[52] U.S. Cl. ..... 340/384 E; 340/326; 340/573; 340/691; 446/404; 446/409

[58] Field of Search ..... 340/326, 573, 691, 384 E; 455/344; 362/157, 802; 446/397, 404, 408, 409

[56] References Cited

U.S. PATENT DOCUMENTS 4,160,339 7/1979 Dankman et al. ..... 340/974 X
4,270,764 6/1981 Yamada ..... 280/809 X
4,468,656 8/1984 Clifford et al. ..... 340/539
4,701,146 10/1987 Swenson ..... 362/802 X
4,824,139 4/1989 Robbins ..... 455/344 X
4,836,075 6/1989 Armstrong ..... 446/485 X

*Primary Examiner*—Jin F. Ng
*Assistant Examiner*—Jeffery A. Hofsass

[57] ABSTRACT

A battery-powered, electro-mechanical device which automatically generates sound-effects and flashing lights depending on its position or tilt is disclosed. The device, housed in a rigid encasement, consists of a position/tilt actuator and sensor, an electronic circuit board, a sound-effects generator, an amplifier, a speaker, LED lamps and driver. The device can be attached to the underside of a skateboard between the forward and rearward trucks.

12 Claims, 7 Drawing Sheets

SOUND-EFFECTS GENERATING DEVICE FOR ACTIVITY TOYS OR VEHICLES

BACKGROUND OF THE INVENTION

1. Field of the Invention

This invention relates in general to an electro-mechanical device for generating sound-effects and flashing lights with a change in position or tilt of said device and more particularly it relates to such devices being incorporated with toys whose position or tilt changes with use during play.

2. Description of the Prior Art

With the exception of a few sound generating toys such as dolls that cry when they are tipped, most toys or devices require some form of manual intervention to generate tones or sound-effects. Most of the modern electronic devices can generate sophisticated tones and sound-effects such as machine-gun fire, phaser, death-ray, mass-invert, bombs, etc., but they usually require different buttons to be pushed manually to select the various sounds-effects. Likewise, if the device has a manually-operated trigger button, then selector switches must be set previously to output the desired sound-effects.

Video games, which are extremely popular, employ a mixture of video graphics and tones or sound-effects to stimulate interest. The player usually utilizes a joystick or the like, as an input device to the game, to control the movement on the screen and the game responds with sounds relative to the actions produced on the screen. The joystick is position sensitive and is manually controlled by the player. Joysticks, used by computers, are mostly devices which give a finite resolution of linear position in the four quadrants of its XY plane, while joysticks, used with video games are usually on/off contacts in each direction of the X and Y axis limiting the angular resolution.

Lately, a few devices have appeared on the market which generate sound-effects, these are radar-like units for the frustrated driver, the portable personnal avenger devices and the handle-bar mounted devices for bicycles. However, all of the above-mentioned devices require manual operation to select the various tones or sound-effects.

The popularity of toys and games producing sound-effects combined with the enthusiasm for activity toys and recreational vehicles, would certainly result in an interesting product if sound-effects are generated while riding a toy or vehicle such as a skateboard, bicycle, or similar vehicle without pressing buttons. Likewise, hand-held toys such as toy airplanes could automatically generate sound-effects by tilting actions during its play or use. One such product is described in U.S. Pat. No. 4,824,139. However, this device is basically a radio mounted under the skateboard. Once powered up and a station is manually selected, the radio plays independently of the rider's actions. Another device is described in U.S. Pat. No. 4,270,764, entitled, "Noise-maker for a Skateboard". This device, however, is a purely mechanical/acoustical design limited to only one sound, produced through motion, regardless of the actions of the rider, or tilts to which the skateboard is subjected to.

Thus, it is apparent that there is a need for a device which can automatically generate different sound-effects and flashing lights with a change in position or tilt of said device when such device is mounted on a vehicle or toy controlled by the action of the user.

SUMMARY OF THE INVENTION

It is therefore one object of this invention to provide a battery-powered, electro-mechanical device which can automatically generate sound-effects with a change in its tilt, position or movements without requiring buttons to be pressed, or switches to be manually selected.

Another object of this invention is to mount this device on a recreational vehicle such as a skateboard where the user's actions to control and change directions results in changing the position or tilt of the board and automatically generate sound-effects and flashing lights relative to the position detected. In this mode of operation, the user whose riding skills, techniques and stunts are all well known by amateurs of this sport, becomes a human joystick controlling the sounds and lights generated. In yet a further object of this invention, changes to the level and direction of the device are detected with respect to the true horizon of the terrain or surface on which the skateboard is located, whether the board is moving or stationary, automatically generating sound-effects relative to said detected level and direction.

It is yet a further object of the invention to provide a sound-effect generating device which can be safely and securely mounted on a toy or moving vehicle and is environmentally safe. The objectives of this invention are achieved as follows: The electro-mechanical device is designed to automatically generate sound-effects and flashing lights when its position is changed or tilted. The device is battery-powered and housed in a rigid encasement and consists of, in its simplest form, an actuator and sensor for detecting the position/tilt states of the device whereby the detected states produce distinct electronic signals which are routed through an electronic circuit board to the inputs of a sound-effect generator programmed to assign from its internal memory of pre-programmed sound-effects, a different sound-effect or tone combination relative to each position and/or tilt state detected. Waveform outputs generated by the programmed sound-effect generator drive an audio amplifier/ loudspeaker and a LED lamp driver so that the effects are made audible and visible.

The actuator and sensor housed in the device can be chosen from a multitude of available products which can be adapted to meet the objectives of the invention. Some of which are as follows:

a) sealed mercury or electrolytic tilt switch(es); or
b) mechanical contacts with appropriate actuator; or
c) reed switches actuated by permanent or electrical magnet(s); or
d) conductive rubber contacts and actuator; or
e) optical photo transmissive or reflective switches and actuator; or
f) capacitive or inductive proximity sensors; or
g) resistive potentimetric sensors; or
h) pressure-sensitive piezo-electric film and actuator; or
i) pressure sensors; or
j) thermal sensors; or
k) linear variable differential transformers.

The sensed output signal from the actuator/sensor may be directed directly to the inputs of the sound-effect generator or appropriately interfaced by means of electronic circuitry. The actuator is preferably self-contained and external to the sensor. The sound-effects generator is designed with a built-in timer which is programmed to swap or rotate the sound-effects from their assigned positions to adjacent or new positions after a predetermined time interval.

The sound-effects generator is also programmed to produce more sound-effects or tones than the actual number of positions it can detect, and after a predetermined time interval a rotating sound pattern shifts out the sound-effect assigned relative to a particular position and introduces a new sound-effect relative to that position. The number of sound-effects generated is limited only by the size of the memory within the sound-effects generator before the whole cycle is repeated.

A timer switch position can also be sensed by an input to the sound-effects generator which is programmed to command the action of the built-in timer to freeze the rotating sound pattern when the switch is OFF, while allowing the resumption of the rotating sound pattern when the switch is back in the ON position. LEDs are positioned on the outer perimeter of the encasement which are activated to flash or blink at fixed or varying duty cycles and rates, by the sound-effects generator through an LED driver.

In order to easily change batteries and facilitate the servicing of the device, battery compartments are positioned within and around the perimeter walls of the encasement with door openings in the rear.

In a preferred embodiment of the invention, the battery-powered, electro-mechanical device is housed in a rigid encasement and automatically generates sound-effects and flashing lights by employing a sealed actuator having a non-metallic body, a spherical concave well which is surrounded by a cushioned circular wall. A magnet enclosed within the body of the actuator glides or rolls on the surface of the well when the position of the device is tilted or moved. A sensor consisting of reed switches is positioned to detect the position of the actuator when it is tilted or moved. This is accomplished by the magnetic influence of the magnet on the switches which produces distinct electronic signals routed to the inputs of a sound-effect generator programmed to assign from its internal memory of pre-programmed sound-effects, a different sound-effect or tone combination relative to each position and/or tilt detected. The waveform outputs generated by the programmed sound-effects generator drive an audio amplifier/loudspeaker and, an LED lamp driver in order to make the generated effects audible and visible.

The sound-generating device disclosed can be easily mounted on a moving object such as a recreational toy or vehicle, preferably a skateboard in which case the device is mounted on the underside of said vehicle between the forward and rearward trucks. The above mentioned objects of this invention together with the brief summary presented above will be more fully explained in the detailed description of the invention.

BRIEF DESCRIPTION OF THE DRAWINGS

A further understanding of this invention is presented by reference to the following detailed description read in conjunction with the accompanying drawings, wherein.

DETAILED DESCRIPTION OF THE INVENTION

Figure 1:
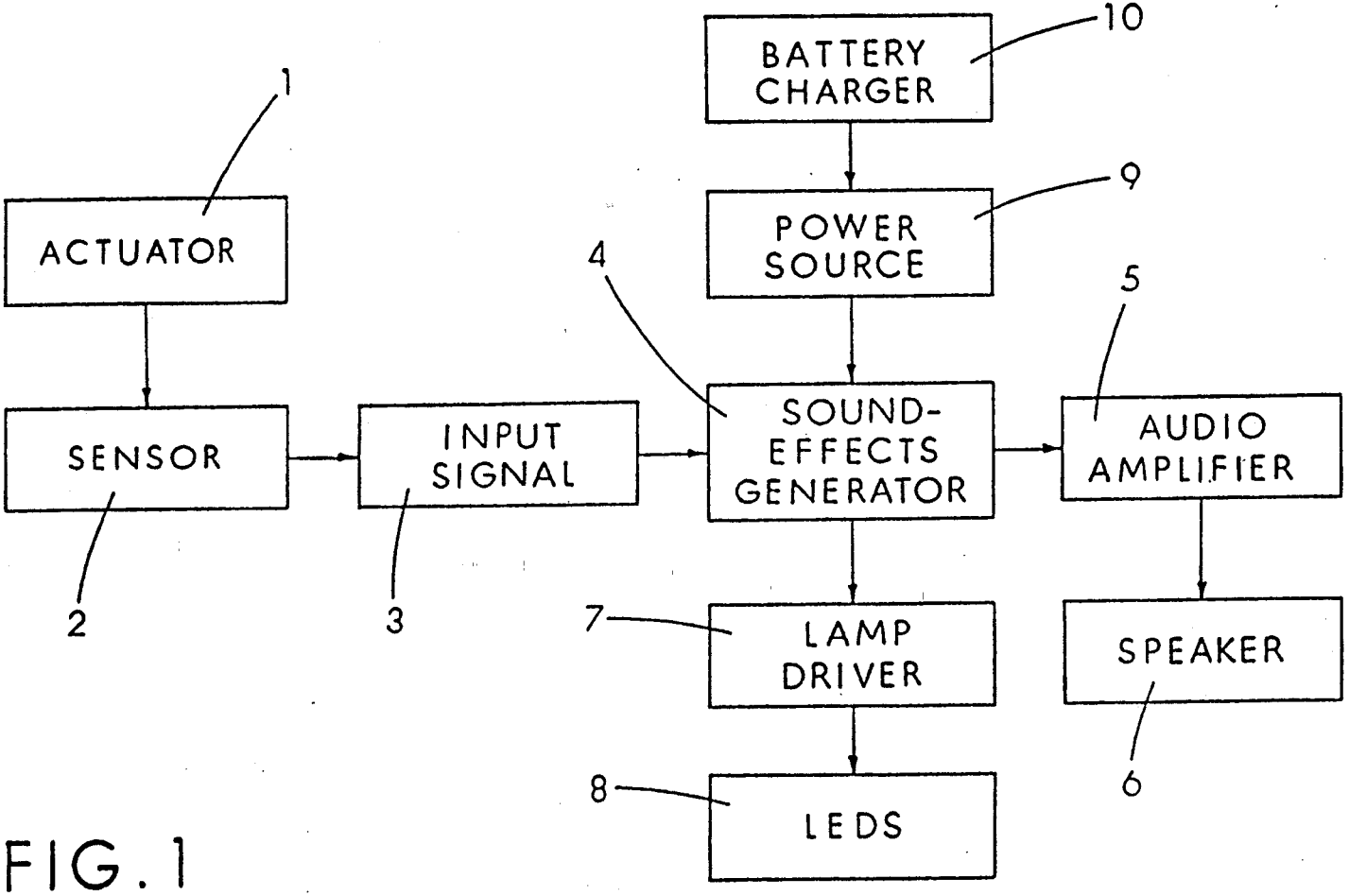
FIG. 1 is a block diagram of a general aspect of an embodiment of the electro-mechanical device of this invention.

As seen in FIG. 1, the electro-mechanical device consists of an actuator 1 and a sensor 2 for detecting the position and/or tilt state of the device; input signal 3 produced by said detected state directed to the input of a sound-effects generator 4 which is programmed to assign and generate a different sound-effect or tone combination relative to each position or tilt state detected. An audio amplifier 5, a loudspeaker 6, an LED driver 7 with LEDs 8, together with a power source 9 and battery charger 10 complete the operation of the device.

Figure 2:
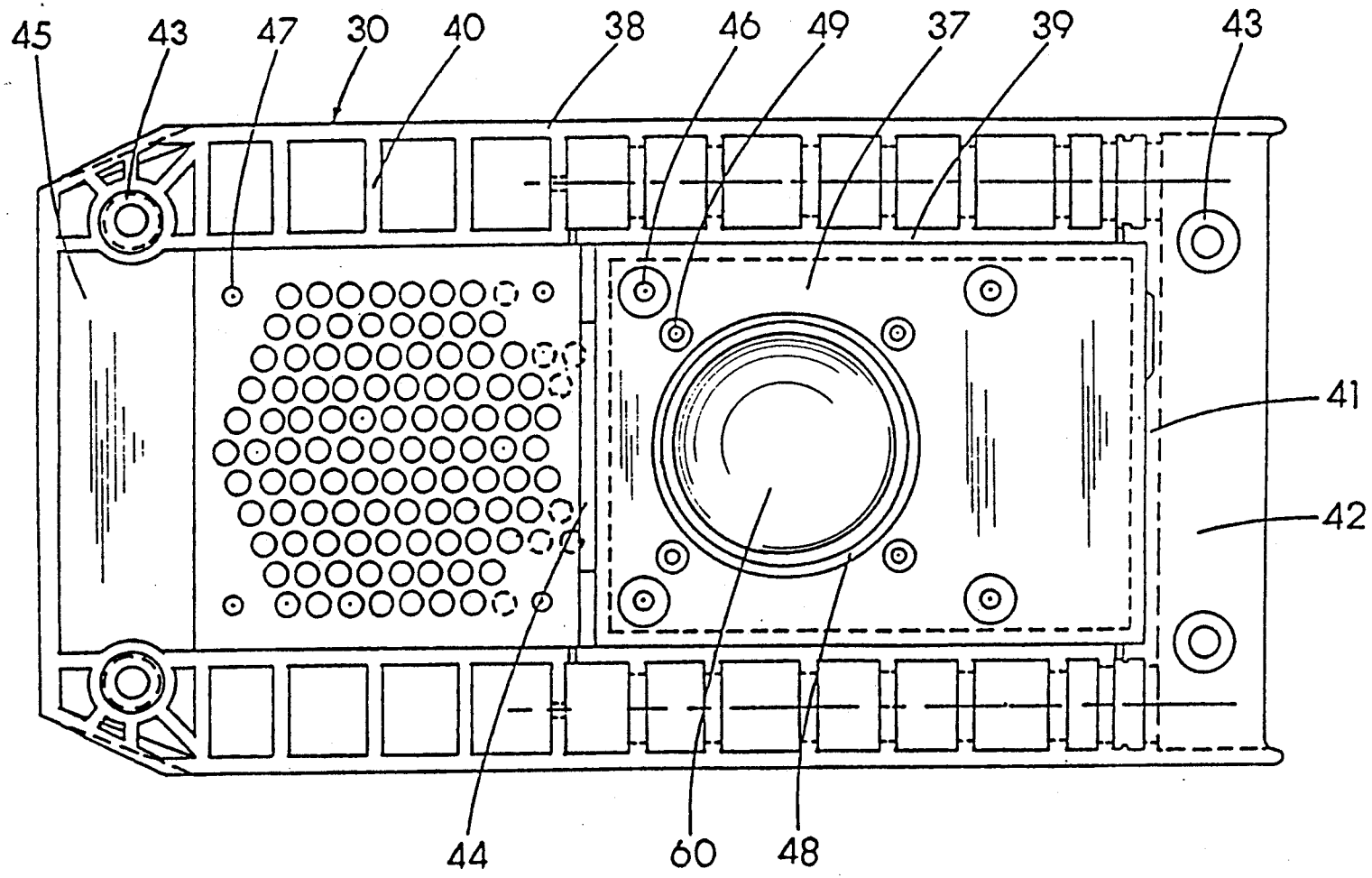
FIG. 2 is a top view of the device constructed in accordance with the preferred embodiment of the present invention without major components or sub-assemblies installed.

Referring to FIG. 2, the top view of the case is shown without major components or sub-assemblies installed. The case 30 includes a bottom wall 37, side walls 38, internal ribs 39 parallel to the side for strength, a plurality of internal ribs 40, a cross rib 44, a rear wall 41, a rear flange 42 and mounting pads 43. The case also includes a front sloping wall 45, a plurality of mounting posts 46 and 47, a circular-wall 48 around a concave well 60 and a suitable number of raised attachment pads 49. All of the above are constructed in a generally rectangular box-like encasement with an open top to allow the vertical mounting of most components and sub-assemblies as will be further illustrated.

Figure 3:
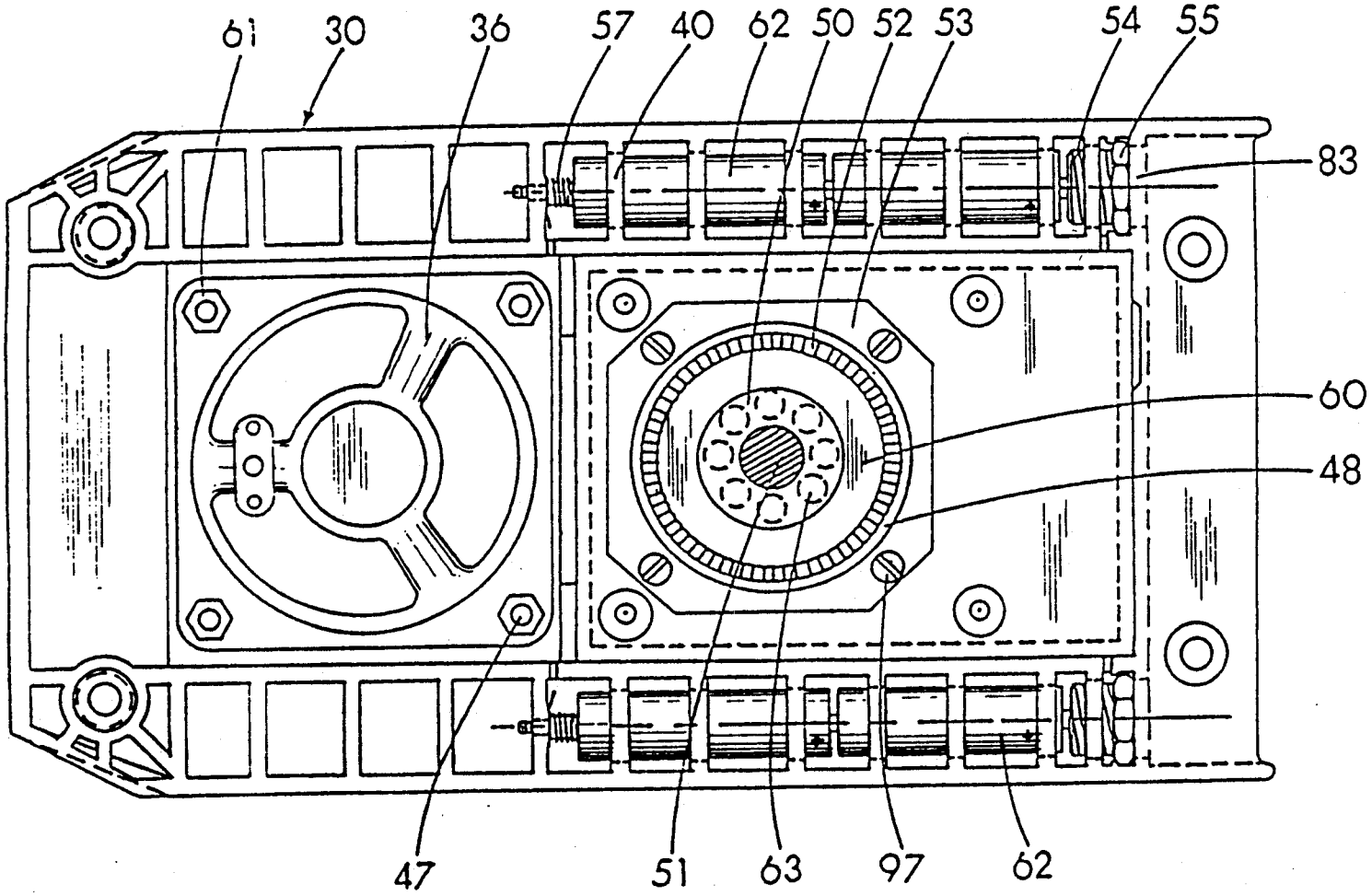
FIG. 3 is a top view of the device in accordance with a preferred embodiment of the invention with some of the major components installed.

The top view of case 30 is again shown in FIG. 3, but this time with the following parts installed: the position/tilt actuator assembly consisting of a non-metallic body (circular wall 48 and concave well 60), a gliding or rolling magnet 51 (contained in a disc-shaped plastic ring 50 having a hole in its center and supported by a plurality of ball-bearings 63 installed into symmetrically spaced holes at the bottom of the ring), seal 52, and cover 53. The rubber seal is installed around the inside of the circular wall and the cover is positioned over the entire well and held in place by screws 97. The seal and the cover prevent dirt from entering the well during normal operation. The rubber seal also serves to shock-absorb the position/tilt actuator ring during lateral movement within the well. The cover also serves to retain the actuator ring within the well and to restrict the actuator ring from excessive vertical movement so that the ball-bearings do not jump out of their locating holes in the bottom of the ring. When the device is tilted in different positions, the whole actuator ring rolls around within the well as it reacts to gravity.

Also shown in FIG. 3 is speaker 36, spring nuts 61, the spring-loaded negative battery contact 57, the positive battery contact plug 54 and retainer nut 55. Aligned holes within the internal ribs 40 provide a housing for the batteries between the contacts. One such arrangement exists on each side of the device. The batteries are accessible through the openings 83 in the rear of the device once the threaded contact plugs are removed. The speaker is mounted face down at the bottom of the case, with posts 47 extending through the four corner mounting holes of the speaker and is retained in place by spring nuts threaded onto the posts.

Figure 4:
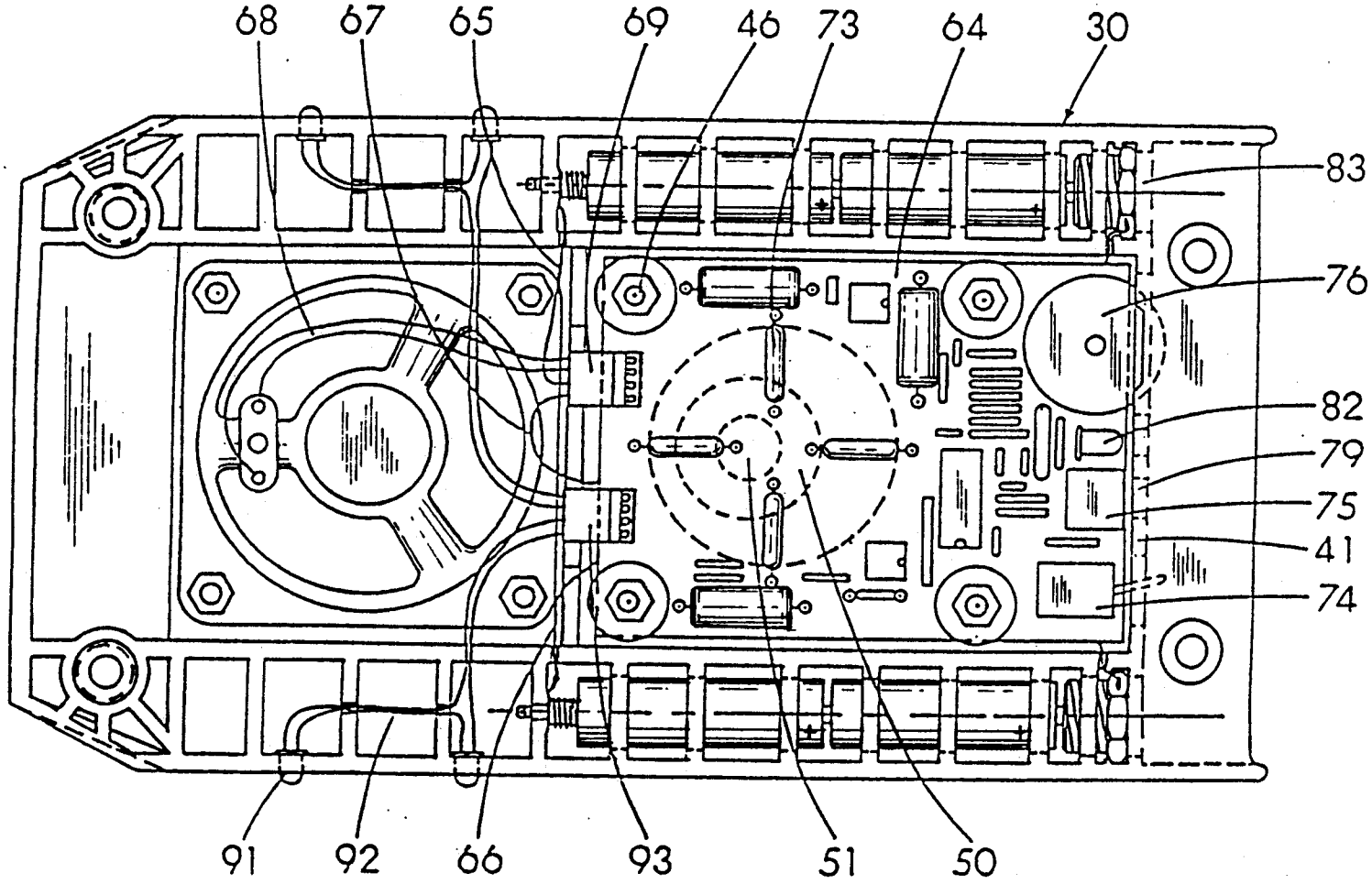
FIG. 4 is the top view of the device in accordance with a preferred embodiment of the invention showing the electronic circuit installed.

Referring to FIG. 4, the electronic circuit board 64 is installed in the case 30 and shock-mounted on four mounting posts 46. Four reed switches 73 are symmetrically spaced and positioned on the circuit board in a predetermined location, such that once the circuit board is installed, the reed switches are centered directly above the concave well of the actuator. This physical alignment of the reed switches permits sensing of position or tilt of the device by means of the action of magnet 51 on the reed switches. Plug-in header 69 provides the means of connecting the battery wires 65 and 67 as well as the speaker wires 68 to the circuit board. Wire 66 connects the pairs of batteries in series as is required. Plug-in header 93 provides the connection of wires 92 to the LEDs 91 mounted along the sides of the device. The location of the controls and access to the batteries is also illustrated in this figure. The ON/OFF switch and volume control 76 is utilized in the same manner as on/off/volume controls of a portable radio. The paddle lever of the timer switch 74 protrudes through the rear wall 41 for access by the user. Opening 79 allows access to the DC power jack 75 for recharging ni-cad batteries. An AC adapter with DC output on a standard power plug provides charging voltage and current. The DC plug is inserted into the jack by means of clearance hole 79 through the rear wall. The LED light 82 is visible, during charging. The rear of the unit also allows access to the batteries by removal of the contact plugs 54. Once the plug is removed, the batteries can drop out from inside the case through opening 83. A slightly different design of the retainer plug could be conceived, with the same results. The plugs are located on each side of the case 30 to permit unobstructed removal of the batteries once the device is installed on a skateboard.

Figure 5:
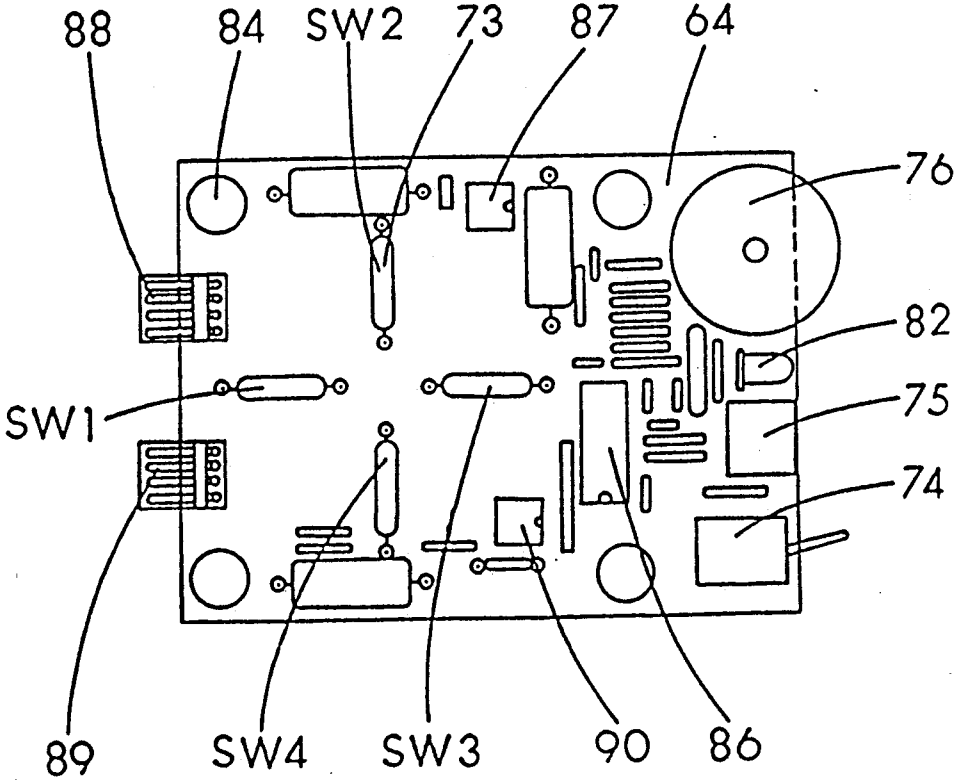
FIG. 5 an enlarged top view of one embodiment of the electronic circuit board layout showing its main components.
Figure 6:
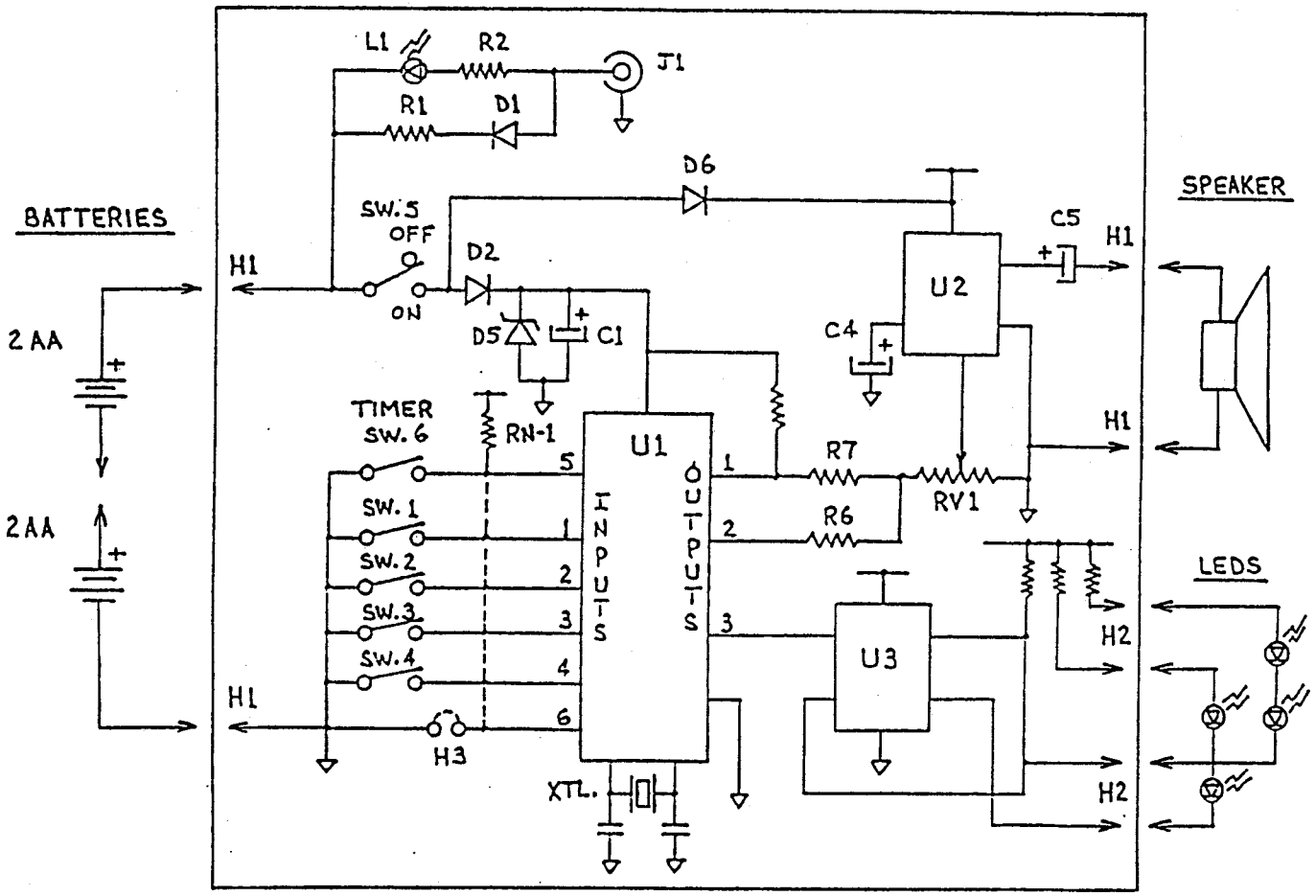
FIG. 6 is a simplified schematic of the electronic circuitry of the device of this invention.
Figure 7A:
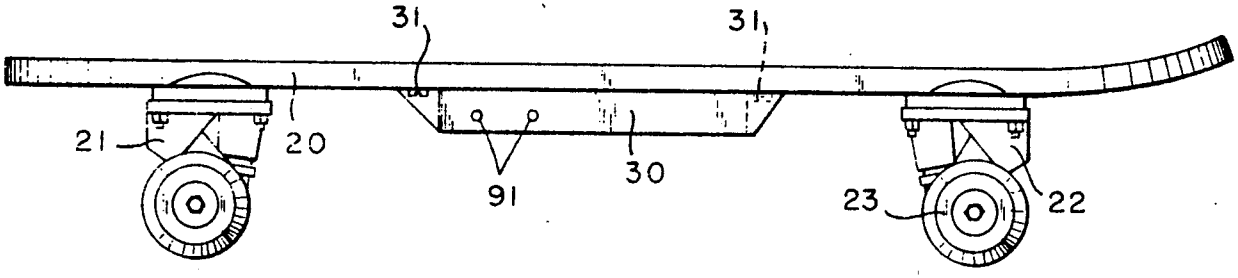
FIG. 7*a* a perspective side view of the inventive device mounted on the underside of a skateboard between the forward and rearward trucks.
Figure 7B:
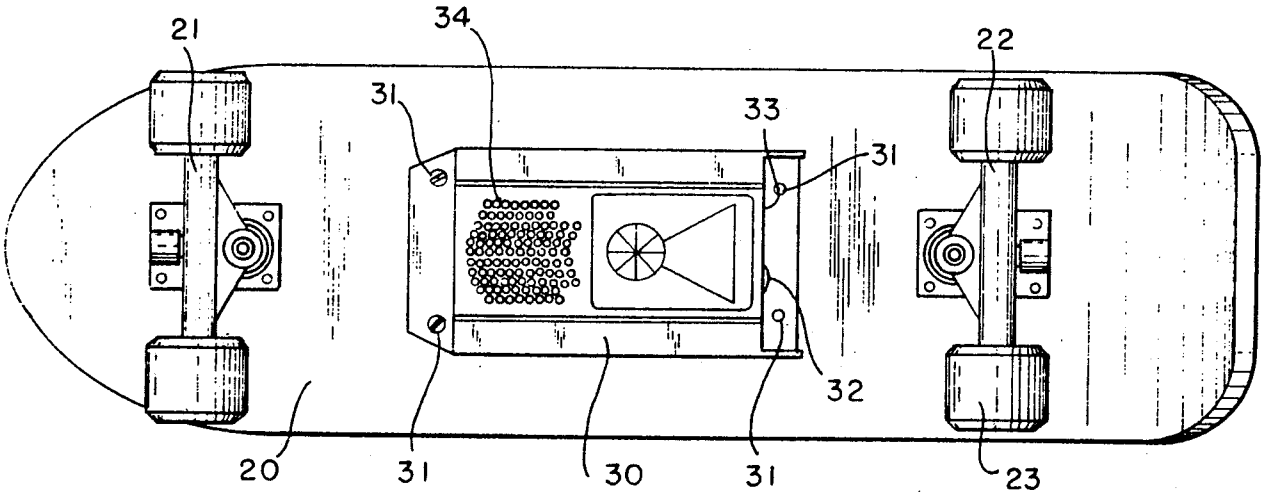
FIG. 7*b* is a perspective bottom view of the inventive device mounted on the underside of a skateboard between the forward and rearward trucks.

FIG. 5 illustrates the typical layout of the circuit board and identifies some of the main components. Components 74, 75, 82 and 76, previously described in FIG. 4, are on the extremity of the board 64 for access, by the user, from the rear of the case 30, once installed. Mounting holes 84 provide means for installation and alignment of the circuit board over the actuator by the positioning of the board onto mounting posts (not shown). Reed switches 73 are positioned in such a manner to be centered over the concave well of the actuator below the circuit board. Header 88 provides the means for the electrical power and speaker connections to the circuit board. The power amplifier 87 and custom-designed microcontroller chip 86, header 89 for means of connecting to the LEDs and the IC chip 90, which drives the LEDs, are also shown together with a plurality of support components. With reference to the simplified schematic of FIG. 6, the four "AA" batteries are connected to the circuit board by header H1. Battery power is applied to the circuit by means of the ON/-OFF switch SW.5. With the switch closed, the circuit is powered through diodes D2 and D6, which serve to provide reverse voltage protection to the circuit should the batteries inadvertently be installed backwards. Diode D2 also serves to prevent the discharge of capacitor C1 through the audio amp U2, should the contact of SW.5 be momentarily interrupted by a mechanical shock to the device. The circuit will operate with input voltages of 4 to 6.5 volts DC.

A battery-charging circuit is also incorporated. This requires an input of 9 volts DC at 50 mA from an AC adapter with a plug suitable to connect to the DC power jack J1. Diode D1 also prevents reverse polarity from being applied to the batteries and circuit. Resistor R1 limits the current to allow the batteries to charge to their full-charge voltage and, at the same time to prevent damage to the batteries should the charging current be left on continuously. Resistor R2 limits current through the LED L1 which indicates that the charging circuit is active. Zener diode D5 protects the circuitry should the DC voltage be applied, through jack J1, without batteries installed in the device. The microcontroller chip U1 requires an external crystal XTL or resonator to complete its internal oscillator clock circuit. The sound-effects are produced by the audio signal at OUTPUT BIT 1 of chip U1 which is a combination of variable frequencies and tones of controllable duty-cycle and constant amplitude. OUTPUT BIT 2 is connected by R6 across the resistor divider, after R7, to decrease the amplitude of the audio output by a fixed level. Both output bits 1 and 2 are configured as open-collector outputs which only sink current. The combined signal output is fed to the volume control potentiometer RV1 and then to the input of the audio power amplifier U2. The power amp is decoupled by capacitor C4 and its output is AC-coupled by capacitor C5 to the loudspeaker, through header H1. OUTPUT BIT 3 produces the output signal applied to chip U3 which drives the LEDs connecting to header H. There are two sets of LEDS which are driven on alternate cycles by driver U3, and therefore they may be hooked-up to flash in unison or alternately on each side of the device, at a fixed frequency or at variable frequencies relating to the sound-effects.

The various sound-effects produced are typically those of machine guns, sirens, phasers, death-rays, bombs and other sounds as well as multiple-tone melody sounds similar to those produced in electronic games. The multitude of sound-effects are a direct result of the number of inputs scanned by the microcontroller chip. The four reed switches 73 of FIG. 5, shown on the schematic as SW.1, SW.2, SW.3 and SW.4, are symmetrically positioned in an XY pattern on the circuit board just above the position tilt actuator magnet, located in the concave well below the circuit board.

This arrangement of reed switches allows for determining the position of the actuator magnet by the magnetic influence on the reed switches. If the device is tilted forward, the actuator magnet rolls forward the resultant magnetic field closes reed switch SW.1. Likewise, if the device is tilted backward, the actuator magnet rolls backward and reed SW.1 opens, while reed SW.3 closes. A tilt to the left or right closes switches SW.4 and SW. 2 respectively. Four distinct positions are detected along the XY axes. Other possible positions are detected as well. If the device is tilted backward and to the right at the same time, switches SW.2 and SW.3 both close; the microcontroller determines this intermediate position by reading the combination of inputs. Likewise, the three other intermediate positions could be determined. Eight tilt positions can be detected by this simple switch arrangement. A ninth position could be detected as the center-off position when the actuator magnet is in the center of the well, and all reed switches are open. This action is similar to the operation of manually-controlled joysticks or button pads of electronic video games which detect movements in only eight directions.

Tilts are not the only means of actuating the reed switches to produce the various sound-effects. Movements of the device from side to side for example, creates moments of inertia which propel the position/tilt actuator magnet in the same direction as the movement, actuating the corresponding reed switch or switches, and thereby producing the desired sound-effects.

Movements of the actuator magnet by maneuvers of the user are not the only means of altering its position. The user may be perfectly still, yet the surface or terrain travelled on, may not be level, and the actuator magnet shifts on its own, due to the forces of gravity.

The four reed switch inputs are sensed by INPUT BITS 1,2,3 and 4 of the microcontroller. Other techniques of producing the same results, well known to the art, could be utilized without affecting the novelty of this invention.

Switches could all be the normally closed type with the actuator ring in the middle position and movement in a direction would cause a switch or two to open. Header H3, which is INPUT BIT 6, is used for that purpose. It is optionally installed during manufacture to define the polarity of the actuator contact or signal provided so that the microcontroller can differentiate between normally open and closed contacts or, the polarity of the input signal.

Other types of actuator and sensor devices and techniques may be utilized, among these: mercury or electrolytic tilt switches, optical, capacitive or inductive proximity sensors and mechanical contacts. Additionally there are pressure-sensitive piezo-electric film or conductive rubber contacts. All of these devices, together with appropriate interfacing to the microcontroller, can produce the same result.

The nine positions sensed by the microcontroller enable it to go through look-up tables and jump to sections of code that will produce pre-programmed sound-effects for that particular position. A dedicated sound-effects generator chip with limited sounds could also be utilized, however, the flexibility of the custom-designed microcontroller chip adds some distinct advantages. Without any extra circuitry, the custom chip allows the use of its internal timer to create a shift in the look-up table. This results in the respective sounds shifting around the eight positions in a circular pattern after a predetermined time interval. Each sound is assigned relative to each position, in turn, for a certain length of time. The main advantage is that if the user were to preferably shift his vehicle from side to side, the same two sounds associated with these positions would not always be heard. Eventually all of the sounds would be heard. With the addition of timer switch 74 (shown as SW.6 on this schematic) which is read by the microcontroller as INPUT BIT 5, the user may decide to override this feature by flipping the timer switch off. The microcontroller will freeze the sound pattern in its present state allowing the user to listen to these particular sound-effects during maneuvers. The user may resume the rotating sound pattern at anytime by flipping the timer switch back on.

Another advantage of using a custom chip is the ability of introducing more sounds than there are positions sensed by the inputs. This is also accomplished using the timer interval, whereupon the microcontroller not only shifts the sound pattern by shifting the look-up table, but also extends the look-up table. For example, as the sound pattern rotates around the positions, the first sound would be dropped instead of shifting it into the last position, and a new sound could be introduced into that position. The number of sounds is limited only by the size of the memory in the microcontroller, which determines the limit of the look-up table and the pre-programmed sounds. At the end of its cycle of sounds, the pointer in the look-up table is reset to the start of the table and the first sound will be reintroduced and the whole cycle repeated. This action again can be locked or un-locked by means of the timer switch. These advantages are desirable features and are made available only in a custom-designed sound-effects chip.

With reference to FIGS. *7a* and *7b*, the construction of the device is shown in its general form, typically installed under a vehicle such as a skateboard 20.

In FIG. *7a* a rigid encasement 30 is mounted on the bottom of the skateboard along the centerline between forward truck 21 and rearward truck 22. The low profile of the case provides ample clearance in height between the ground-engaging wheels 23 and the bottom of the board. A plurality of LEDs 91 are visible on the sides of the case.

In FIG. *7b* a plurality of sound baffle-holes 34 are located in the bottom of the case for the emission of generated sounds. Mounting screws 31 are utilized to mount the case to the bottom of the skateboard. The position of the ON/OFF switch and volume control 32 is shown at the rear of the device, as well as that of the timer switch 33.

The device can be installed on skateboard 20 as shown allowing access to the controls, batteries and the power jack. It is recommended that the side hand rails, such as those used to protect the bottom surfaces of the skateboards, be extended if necessary to further protect the device.

The device of this invention can be incorporated into a different shape or style, as for an example by moulding it into the moving object or vehicle, provided it retains a low profile and is rigidly constructed to absorb the punishment that this device is subjected to during utilization.

In the foregoing description, certain terms have been used for brevity, clearness and understanding but no unnecessary limitations are to be implied therefrom beyond the requirements of the prior art, because such terms are used for descriptive purposes and are not intended to be broadly construed. Moreover, the description and illustration of the invention is by way of example, and the scope of the invention is not limited to the exact details of the construction shown or described. Having now described the features, discoveries and principles of the invention, the manner in which the device is constructed and assembled, the characteristics of the device and the advantages, new and useful results obtained; the new and useful features, devices, elements, arrangements, parts, and combinations are set forth in the appended claims.

I claim:

1. A battery-powered, electro-mechanical device, housed in a rigid encasement, for automatically generating sound-effects and flashing lights with a change in position and/or tilt of said device, characterized by:

a) an actuator with sensors symmetrically spaced within the periphery of the actuator which reacts to
   i) moments of inertia whenever the position of said device is moved, and
   ii) forces of gravity whenever said device is tilted from its normal horizontal operating level,
   said actuator activating said sensors such that when any one sensor or two adjacent sensors are activated, separate detected states corresponding to the position or tilt of said device are determined, whereby said detected states produce distinct electronic signals;
b) means for directing said distinct electronic signals to inputs of a sound-effects generator programed to assign from its internal memory of pre-programmed sound-effects, a different sound-effect for each distinct electronic signal representative of a particular position or tilt state detected; the assignment of said sound-effects constitutes a sound pattern relative to detected position or tilt states of said device,
c) said sound-effects generator programmed to generate waveform outputs representative of said assigned sound-effects relative to said detected states, said waveform outputs are applied to:
   i) the input of an audio amplifier which drives a loudspeaker to produce said sound-effects and,
   ii) the input of an LED driver which drives a set of LED lamps producing visible effects.

2. An electro-mechanical device as claimed in claim 1 characterized in that the sensors and sensor activating means of said actuator consists of either:
a) sealed mercury or electrolytic tilt switch; or
b) mechanical contacts with an appropriate activator; or
c) reed switches activated by permanent or electrical magnet or magnets; or
d) optical photo-transmissive or reflective switches and actuator or activators.

3. An electro-mechanical device as claimed in claim 1 characterized in that said sound-effects generator has a built-in timer programmed to shift said sound-effects relative from their assigned positions to adjacent positions after a predetermined time interval;
successive time intervals and shifts result in a rotating sound pattern as said sound pattern shifts to newly assigned positions relative to their previously assigned positions;
a whole cycle is completed when said rotating sound pattern has shifted through all positions relative to said detected states, and has returned to the originally assigned positions.

4. An electro-mechanical device as claimed in claim 3 characterized in that said sound-effects generator produces more sound-effects relative to said detected position or tilt states, said sound-effects generator having memory means which stores a multitude of sound-effects and after said predetermined time interval, introduces a new sound-effect into said rotating sound pattern relative to a particular position by replacing the sound-effect previously assigned relative to that position, successive shifts introduces new sound-effects into said rotating sound pattern thereby expanding the number of sound-effects assigned relative to each position or tilt state detected.

5. An electro-mechanical device as claimed in claim 4 characterized in that the number of sound-effects produced is limited only by the size of the memory within said sound-effects generator and that when all said sound-effects have been produced, the whole cycle repeats itself when the original sound-effects are reintroduced into said rotating sound pattern and then consequently followed by the remaining sound-effects.

6. An electro-mechanical device as claimed in claim 3 characterized in that a timer switch position is sensed by an input to said sound-effects generator which then controls the operation of said built-in timer to freeze or hold said rotating sound pattern relative to their currently assigned positions by disabling the built-in timer when said switch is OFF, and to allow the resumption of the rotating sound pattern by enabling the built-in timer when the switch is ON.

7. An electro-mechanical device as claimed in claim 1 characterized by LEDs positioned on the outer perimeter of said encasement, activated to flash at fixed or variable duty cycles relative to said detected states by said sound-effects generator through an LED driver.

8. An electro-mechanical device as claimed in claim 1 characterized in that said device is mounted on or incorporated into a moving object or vehicle.

9. An electro-mechanical device as claimed in claim 8 characterized in that one vehicle consists of a skateboard and said device is mounted on the underside of, or incorporated into, said skateboard.

10. An electro-mechanical device as claimed in claim 1 characterized in that said sound-effects are electronically generated and are typically machine guns, sirens, phases, death-rays, bombs and other sounds including multiple-tone melody sounds.

11. A battery-powered, electro-mechanical device, housed in a rigid encasement, for automatically generating sound-effects and flashing lights with a change in position and/or tilt of the device characterized by:
a) a sealed actuator having a non-metallic body, a spherical concave well surrounded by a cushioned circular wall in which a magnet glides or rolls as it reacts to:
   i) movements of inertia whenever the position of said device moved, and
   ii) forces of gravity whenever said device is tilted from its normal horizontal operating level,
b) four sensors consisting of reed switches symmetrically spaced and mounted within the periphery of said actuator to detector position or tilt states of said device by the magnetic influence of the magnet on said reed switches such that when any one switch or two adjacent switches are closed by said magnetic influence, eight separate detected states corresponding to the position or tilt state of said device are determined, whereby said detected states produce eight distinct electronic signals;
c) an electronic circuit board, on which said reed switches are installed, is positioned above said actuator and routes said distinct electronic signals to inputs of said sound-effects generator programmed to assign from its internal memory of pre-programmed sound-effects, a different sound-effect for each distinct electronic signal representative of a particular position or tilt state detected; the assignment of eight said sound-effects constitutes a sound pattern relative to said detected positions or tilt states of said device,
d) said sound-effects generator programmed to generate waveform outputs representative of said assigned sound-effects relative to said detected states, said waveform outputs are applied to:

i) the input of an audio amplifier which drives a loudspeaker to produce said sound-effects, and ii) the input of an LED driver which drives a set of LED lamps producing visible effects.

12. An electro-mechanical device as claimed in claim 11 wherein said device is mounted on the underside of a skateboard between its forward and rearward trucks.

* * * * *